US006550318B2

(12) United States Patent
Isobe et al.

(10) Patent No.: US 6,550,318 B2
(45) Date of Patent: Apr. 22, 2003

(54) ABNORMALITY DIAGNOSIS APPARATUS FOR EVAPORATIVE FUEL PROCESSING SYSTEM

(75) Inventors: Takashi Isobe, Wako (JP); Manabu Niki, Wako (JP); Kojiro Tsutsumi, Wako (JP); Hiroyuki Ando, Wako (JP); Takashi Iwamoto, Wako (JP); Satoshi Kiso, Haga-machi (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 45 days.

(21) Appl. No.: 09/822,412

(22) Filed: Apr. 2, 2001

(65) Prior Publication Data

US 2001/0025525 A1 Oct. 4, 2001

(30) Foreign Application Priority Data

Apr. 3, 2000 (JP) ..... 2000-100363

(51) Int. Cl.[7] ..... G01M 15/00
(52) U.S. Cl. ..... 73/118.1
(58) Field of Search ..... 73/117.3, 118.1, 73/119 A, 116; 123/520, 674, 704, 516, 518, 519, 521

(56) References Cited

U.S. PATENT DOCUMENTS 5,680,849 A * 10/1997 Morikawa et al. ..... 123/520
6,082,237 A * 7/2000 Fujimoto et al. ..... 123/520

FOREIGN PATENT DOCUMENTS

JP 9-126064 3/1997

* cited by examiner

*Primary Examiner*—Eric S. McCall
*Assistant Examiner*—Monica D. Harrison
(74) *Attorney, Agent, or Firm*—Arent Fox Kintner Plotkin & Kahn, PLLC

(57) ABSTRACT

An abnormality diagnosis apparatus for performing a leak check of an evaporative fuel processing system which includes a fuel tank, a canister for storing evaporative fuel generated in the fuel tank, a purging passage for connecting the canister to an intake system of an internal combustion engine, and a purge control valve provided in the purging passage. A process of reducing the pressure in the evaporative fuel processing system is executed with a limited flow rate of gases passing through the purge control valve when performing the leak check in an idling condition of the engine. The limited flow rate is set to a value equal to or smaller than a predetermined flow rate which is smaller than the maximum flow rate applied to the leak check performed in operating conditions other than the idling condition. The leak check is performed on the basis of a change in the pressure in the evaporative fuel processing system after the pressure reduction process.

8 Claims, 8 Drawing Sheets

ATMOSPHERIC AIR OPEN
(FOR CORRECTION CHECK)
ATMOSPHERIC AIR OPEN
(FOR PRESSURE REDUCTION)
CORRECTION CHECK
LEAK CHECK
VAPOR CHECK
NORMAL
CONTROL
PRESSURE
REDUCTION
T1
T2
T3
T4
T5

PTANK
t

PURGE CONTROL
VALVE
t

VENT SHUT
VALVE
OPEN
CLOSE

BYPASS
VALVE
OPEN
CLOSE
t0
t1
t2
t3
t4
t5
t6
t

ABNORMALITY DIAGNOSIS APPARATUS FOR EVAPORATIVE FUEL PROCESSING SYSTEM

BACKGROUND OF THE INVENTION

The present invention relates to an abnormality diagnosis apparatus for an evaporative fuel processing system which stores evaporative fuel, generated in a fuel tank, in a canister and purges the evaporative fuel stored in the canister into an intake system of an internal combustion engine at appropriate timings.

As disclosed in Japanese Patent laid-Open No. Hei 9-126064, the abnormality diagnosis for an evaporative fuel processing system for a vehicle is executed under a condition wherein the vehicle is in a so-called cruising state. In other words, the operation of the engine is in the stationary state. The abnormality diagnosis is executed by introducing a negative pressure from an intake system of the engine into the evaporative fuel processing system. Accordingly, at the time the negative pressure is introduced, that is, during the process of reducing the pressure in the evaporative fuel processing system, the amount of the evaporative fuel purged into the intake system tends to increase. Therefore, in order to reduce the purging of the evaporative fuel during the pressure reduction processing abnormality diagnosis is executed under the above-described condition when the vehicle is in the cruising state where the engine is in a stationary condition.

However, depending on the manner in which the user operates the vehicle, there is a possibility that a vehicle operating state capable of executing the abnormality diagnosis, (i.e., a vehicle operating state satisfying the abnormality diagnosis execution condition) may not be obtained. Accordingly, it is also necessary to execute the abnormality diagnosis even in an idling condition of the engine. However, if the above-described conventional abnormality diagnosis executed in the cruising state of the vehicle is applied to the abnormality diagnosis in the idling condition of the engine, the amount of evaporative fuel purged into an intake system of the engine may become excessively large. The large amount of evaporated fuel purged into the intake system may cause the engine to stall since the conventional abnormality diagnosis can only be executed under the condition when the vehicle is in the cruising state.

SUMMARY OF THE INVENTION

An object of the present invention is to provide an abnormality diagnosis apparatus for an evaporative fuel processing system, which is capable of executing an abnormality diagnosis which includes a process of reducing a pressure in the evaporative fuel processing system without causing the engine to stall, especially when the engine is in an idling condition.

In order to achieve the above object, the present invention provides an abnormality diagnosis apparatus for performing a leak check and determining whether or not a leak exists in an evaporative fuel processing system, including a fuel tank, a canister for storing evaporative fuel generated in the fuel tank, a charging passage for connecting the fuel tank to the canister, a purging passage for connecting the canister to an intake system of an internal combustion engine, and a purge control valve provided in the purging passage. Additionally, the abnormality diagnosis apparatus comprises: a pressure sensor for detecting a pressure in the evaporative fuel processing system; pressure reduction processing means for executing a process of reducing the pressure in the evaporative fuel processing system with a limited flow rate of gases passing through the purge control valve when performing the leak check in an idling condition of the engine, the limited flow rate being set to a value equal to or smaller than a predetermined flow rate which is smaller than the maximum flow rate applied to the leak check performed in operating conditions of the engine other than the idling condition; and leak determining means for performing the leak check on the basis of a change in the pressure in the evaporative fuel processing system after the pressure reduction process.

According to the present invention, the process of reducing the pressure in the evaporative fuel processing system is executed with a limited flow rate of gases passing through the purge control valve when performing the leak check of the evaporative fuel processing system in the idling condition of the engine. Specifically, the flow rate is limited to a value equal to or smaller than a predetermined flow rate which is smaller than the maximum flow rate applied to the leak check performed in operating conditions other than the idling condition. After the pressure reduction process, the leak check is performed on the basis of a change in the pressure in the evaporative fuel processing system. Accordingly, the abnormality diagnosis for the evaporative fuel processing system can be performed without rapidly increasing an amount of the evaporative fuel supplied to the intake system of the engine even if the engine is in the idling condition and thereby preventing the inconvenience such as engine stall.

Preferably, the abnormality diagnosis apparatus is an external apparatus provided separately from the engine and a control system. The control system is connected to the evaporative fuel processing system and controls the evaporative fuel processing system. The abnormality diagnosis apparatus performs the leak check by supplying an execution command signal to the control system.

According to the present invention, the abnormality diagnosis can be arbitrarily executed by connecting the abnormality diagnosis apparatus, an external apparatus provided separately from the engine, to the control system in the idling condition of the engine. Therefore, the abnormality diagnosis for the evaporative fuel processing system can be easily executed at the time of inspection or maintenance of the vehicle.

Preferably, the pressure sensor is mounted in the charging passage; and the pressure reduction processing means executes the pressure reduction process by comparing a pressure detected by the pressure sensor with each of a first predetermined pressure (POBJH) and a second predetermined pressure (POBJL) lower than the first predetermined pressure, and gradually increasing the valve opening amount of the purge control valve when the detected pressure reaches the first predetermined pressure while gradually decreasing the valve opening amount of the purge control valve when the detected pressure reaches the second predetermined pressure.

Preferably, the second predetermined pressure is set so that the second predetermined pressure gradually becomes closer to the first predetermined pressure with elapsed time.

Preferably, the leak determining means corrects a raised amount ($\Delta P2$) of pressure in the evaporative fuel processing system within a predetermined time period, after the pressure reduction process, by the pressure reduction processing means, according to a pressure change ($\Delta P1$) which depends on the amount of evaporative fuel generated in the fuel tank. Furthermore, the leak determining means determines that there exists a leak in the evaporative fuel processing system, when a pressure raised amount (ΔP2−ΔP1), after correction, is larger than a predetermined pressure change amount (ΔPLEAK).

Preferably, the abnormality diagnosis apparatus according to the present invention further includes a first evaporative fuel amount determining means for determining an amount of the evaporative fuel generated in the fuel tank during the pressure reduction processing, wherein the pressure reduction process is interrupted when it is determined by the first evaporative fuel amount determining means that the evaporative fuel amount is larger than a first predetermined amount.

Preferably, the abnormality diagnosis apparatus according to the present invention further includes an oxygen concentration sensor for detecting an oxygen concentration in the exhaust gases from the engine, wherein the first evaporative fuel amount determining means determines the evaporative fuel amount on the basis of an air-fuel ratio correction coefficient (KO2) set according to an output of the oxygen concentration sensor.

Preferably, the abnormality diagnosis apparatus according to the present invention further includes a second evaporative fuel amount determining means for determining an amount of the evaporative fuel generated in the fuel tank after measurement of the pressure raised amount (ΔP2), wherein the determination of whether or not a leak exists in the evaporative fuel processing system is withheld when it is determined by the second evaporative fuel amount determining means that the evaporative fuel amount is larger than a second predetermined amount.

The above and other objectives, features and advantages of the present invention will becomes apparent from the following description and the appended claims, taken in conjunction with the accompanying drawings in which like parts or elements are denoted by like reference symbols.

DETAILED DESCRIPTION OF THE PREFERRED EMBODIMENT

A preferred embodiment of the present invention will now be described with reference to the drawings.

Figure 1:
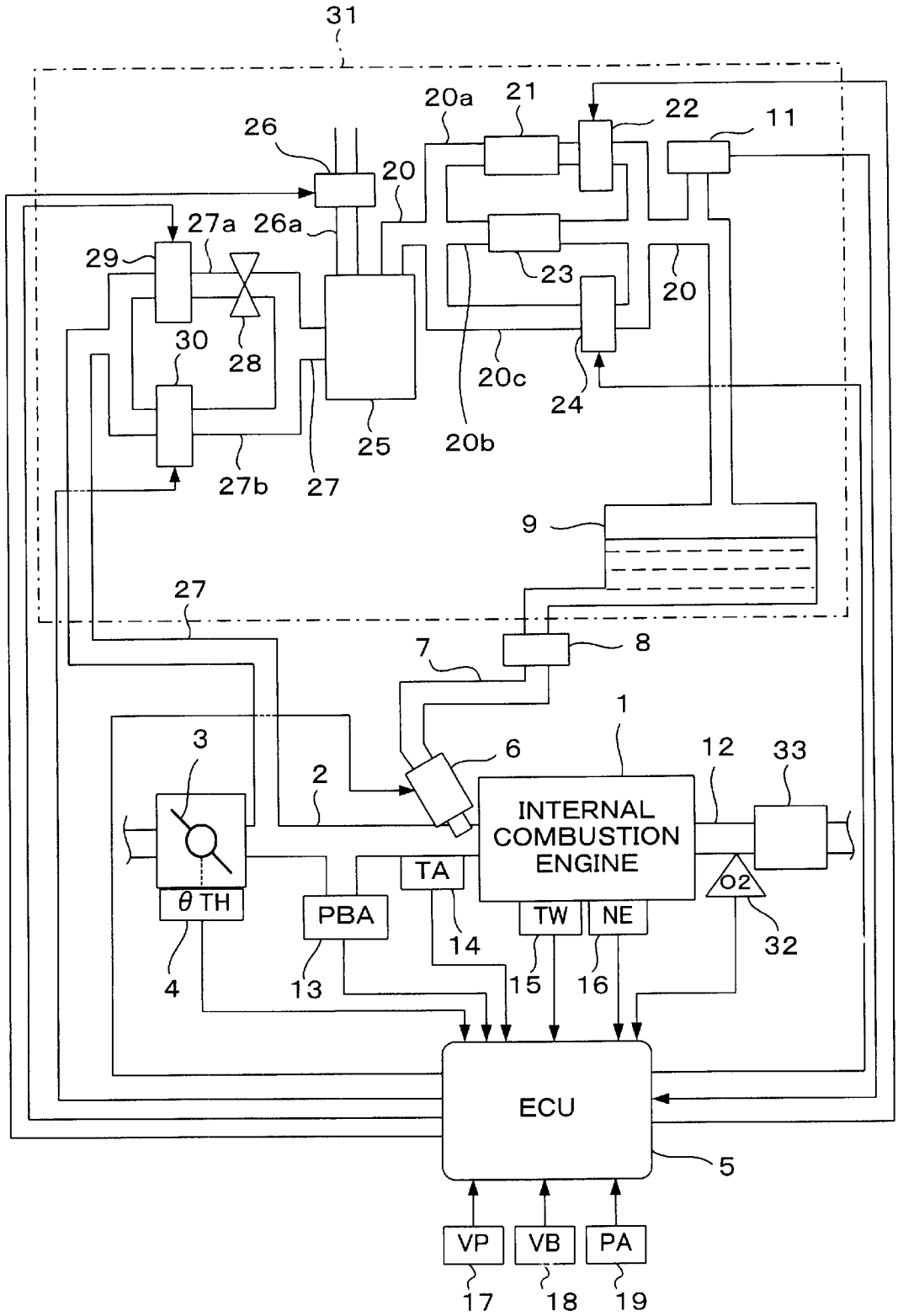
FIG. 1 is a schematic diagram showing a configuration of a control system for an internal combustion engine including an evaporative fuel processing system and an abnormality diagnosis apparatus therefor according to a preferred embodiment of the present invention.

FIG. 1 is a schematic diagram showing a configuration of a control system for an internal combustion engine including an evaporative fuel processing system and an abnormality diagnosis apparatus. Referring to FIG. 1, reference numeral 1 denotes an internal combustion engine (which will be hereinafter referred to simply as "engine") having a plurality of (e.g., four) cylinders. The engine 1 is provided with an intake pipe 2, in which a throttle valve 3 is mounted. A throttle valve opening θTH sensor 4 is connected to the throttle valve 3. The throttle valve opening sensor 4 outputs an electrical signal corresponding to the opening angle of the throttle valve 3 and supplies the electrical signal to an electronic control system (which will be hereinafter referred to as "ECU") 5.

Fuel injection valves 6, provided for respective cylinders, are inserted into the intake pipe 2 at locations intermediate between the engine 1 and the throttle valve 3 and slightly upstream of respective intake valves (not shown). All the fuel injection valves 6 are connected through a fuel supply pipe 7 to a fuel tank 9. The fuel supply pipe 7 is provided with a fuel pump 8. Each fuel injection valve 6 is electrically connected to the ECU 5, and its valve opening period is controlled by a signal from the ECU 5.

The intake pipe 2 is provided with an intake pipe absolute pressure PBA sensor 13 for detecting an absolute pressure PBA in the intake pipe 2 and an intake air temperature TA sensor 14 for detecting an air temperature TA in the intake pipe 2, at positions downstream of the throttle valve 3. Detection signals from these sensors are supplied to the ECU 5.

An engine water temperature TW sensor 15, which is typically configured as a thermister, is inserted in a cylinder peripheral wall, filled with cooling water, of a cylinder block of the engine 1. An engine cooling water temperature TW detected by the TW sensor 15 is converted into an electrical signal and is supplied to the ECU 5.

An engine rotational speed NE sensor 16 is disposed near the outer periphery of a camshaft or a crankshaft (both not shown) of the engine 1. The engine rotational speed sensor 16 outputs a signal pulse (which will be hereinafter referred to as "TDC signal pulse") at a predetermined crank angle per 180° rotation of the crankshaft of the engine 1 and supplies the TDC signal pulse to the ECU 5.

An exhaust pipe 12 is provided with an oxygen concentration sensor 32, which detects an oxygen concentration in exhaust gases and supplies a signal corresponding to the detected value VO2 to the ECU 5. The exhaust pipe 12 is also provided with a three-way catalyst 33 as an exhaust gas purifying device at a position downstream of the oxygen concentration sensor 32.

Further, a vehicle speed sensor 17 for detecting a running speed VP of a vehicle on which the engine 1 is mounted, a battery voltage sensor 18 for detecting a battery voltage VB, and an atmospheric pressure sensor 19 for detecting atmospheric pressure PA are connected to the ECU 5. Detection signals from the sensors 17, 18 and 19 are supplied to the ECU 5.

An evaporative fuel processing system 31 mainly includes the fuel tank 9, a charging passage 20, a canister 25, and a purging passage 27, each of which will be described further below.

The fuel tank 9 is connected through the changing passage 20 to the canister 25. The charging passage 20 has first, second, and third branch passages 20*a*, 20*b*, and 20*c* provided in the engine room. The charging passage 20 is provided with a tank pressure sensor 11 at a position between the branch passages 20*a*, 20*b*, 20*c* and the fuel tank 9. The tank pressure sensor 11 detects a pressure in the charging passage 20 as tank pressure PTANK and supplies the detection signal to the ECU 5. The tank pressure PTANK is equal to the actual pressure in the fuel tank 9 in a stationary state. But in a transient state, as will be described later, the tank pressure PTANK is slightly different from the actual pressure in the fuel tank 9.

The first branch passage 20*a* is provided with a one-way valve 21 and a puff-loss valve 22. The one-way valve 21 is opened only when the tank pressure PTANK becomes higher than the atmospheric pressure by about 1.6 to 1.7 kPa (12 to 13 mmHg). The puff-loss valve 22 is a solenoid valve which is opened during purging of the evaporative fuel and is closed during stoppage of the engine. The operation of the puff-loss valve 22 is controlled by the ECU 5.

The second branch passage 20*b* is provided with a two-way valve 23. The two-way valve 23 is opened when the tank pressure PTANK becomes higher than the atmospheric pressure by 2.7 kPa (20 mmHg) and when the tank pressure PTANK becomes lower than the pressure in the second branch passage 20*b* on the canister 25 side with respect to the two-way valve 23 by a predetermined pressure.

The third branch passage 20*c* is provided with a bypass valve 24. The bypass valve 24 is a solenoid valve which is normally closed and is opened and closed during execution of abnormality determination as described below. The operation of the bypass valve 24 is controlled by the ECU 5.

The canister 25 contains active carbon for adsorbing evaporative fuel, and has an inlet (not shown) communicated through a passage 26*a* to the atmospheric air. The passage 26*a* is provided with a vent shut valve 26 which is normally opened and is temporarily closed during execution of the abnormality determination. The operation of the vent shut valve 26 is controlled by the ECU 5.

The canister 25 is connected through the purging passage 27 to the intake pipe 2 at a position downstream of the throttle valve 3. The purging passage 27 has first and second branch passages 27*a* and 27*b*. The first branch passage 27*a* is provided with a jet orifice 28 and a jet purge control valve 29. The second branch passage 27*b* is provided with a purge control valve 30. The jet purge control valve 29 is a solenoid valve for controlling the flow rate of a purged air-fuel mixture, which is too small to be accurately controlled by the purge control valve 30. The purge control valve 30 is a solenoid valve capable of continuously controlling the flow rate by changing an on-off duty ratio of a control signal. The operations of these solenoid valves 29 and 30 are controlled by the ECU 5. The purge control valve 30 may be a solenoid valve capable of continuously changing the opening degree thereof. The above-described on-off duty ratio is equivalent to the opening degree of such a solenoid valve, the opening degree of which can be continuously be changed.

The ECU 5 includes an input circuit having various functions including a function of shaping the waveforms of input signals from the various sensors, a function of correcting the voltage levels of the input signals to a predetermined level, and a function of converting analog signals values into digital signal values. The ECU 5 further includes a central processing unit (which will be hereinafter referred to as "CPU"); memories for preliminarily storing various calculation programs to be executed by the CPU and for storing the results of calculation or the like by the CPU; and an output circuit for supplying drive signals to the fuel injection valves 6, the puff-loss valve 22, the bypass valve 24, the jet purge control valve 29, and the purge control valve 30.

The ECU 5 determines, on the basis of the various engine parameter signals, each of various engine operating regions such as a feedback control operating region based on an oxygen concentration in exhaust gases detected by the O2 sensor 32 and open loop control operating regions. For the determined engine operating region, the ECU 5 computes a fuel injection time Tout of each fuel injection valve 6 operated in synchronizm with the TDC signal pulse based on the following equation (1):

$$Tout = Ti \times K1 \times KO2 + K2 \quad (1).$$

Ti is a basic value of the injection period Tout of each fuel injection valve 6, and read out of a Ti map set according to the engine rotational speed NE and the intake pipe absolute pressure PBA. KO2 is an air-fuel ratio correction coefficient which is set, during execution of feedback control, according to the oxygen concentration in exhaust gases detected by the O2 sensor 32. In a plurality of the open loop control operating regions where no feedback control is executed, the air-fuel ration correction coefficient KO2 is set to a value suitable for each operating region.

K1 is another correction coefficient and K2 is a correction variable. The correction coefficient K1 and the correction variable K2 are calculated on the basis of various engine parameter signals, and set to predetermined values allowing to optimize various characteristics such as a fuel consumption characteristic and an engine acceleration characteristic according to the engine operating condition.

Figure 2:
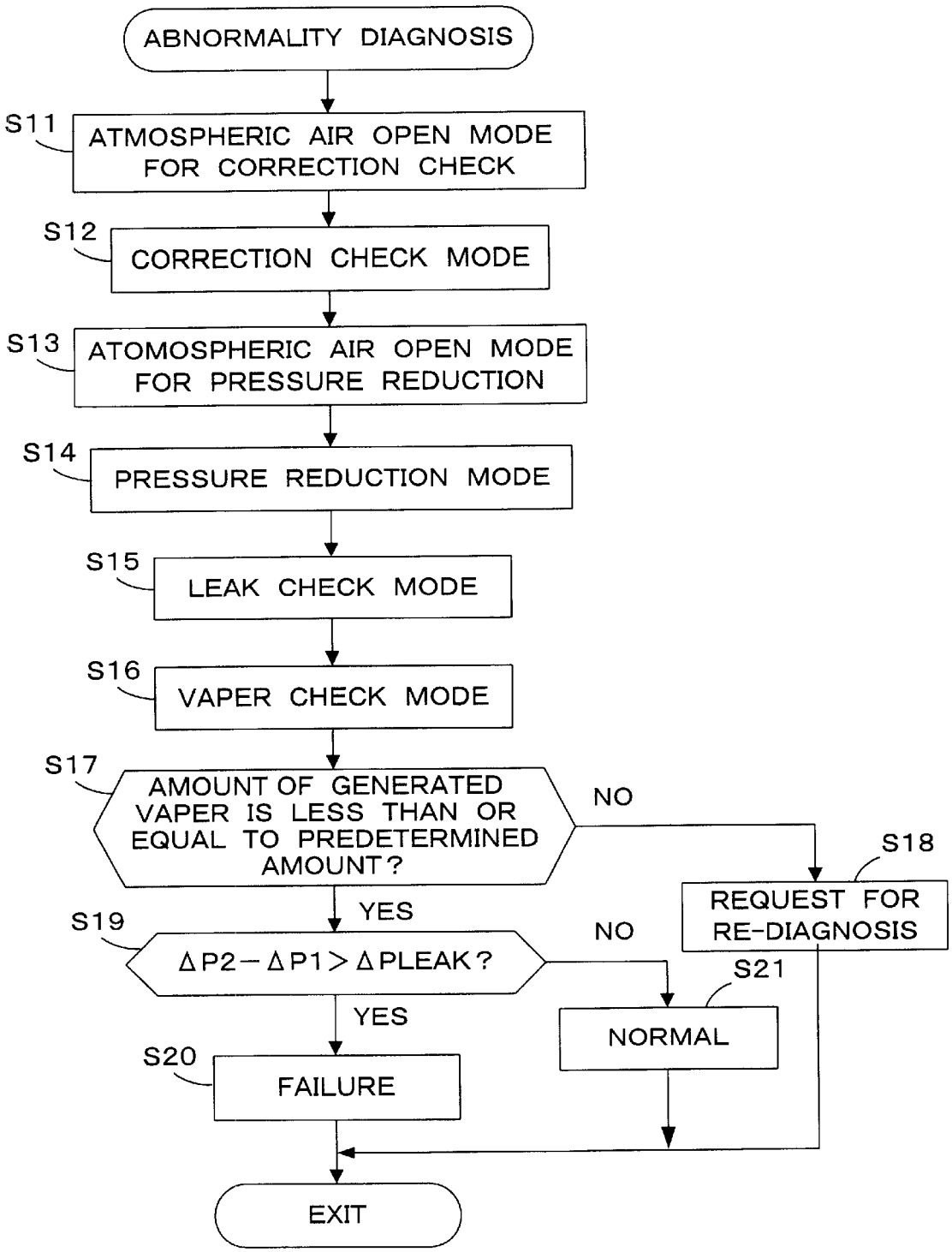
FIG. 2 is a flow chart of an abnormality diagnosis processing for the evaporative fuel processing system.

FIG. 2 is a flow chart illustrating a procedure of an abnormality diagnosis processing according to this embodiment, and FIGS. 6A to 6D are time charts illustrating the whole of the abnormality diagnosis processing shown in FIG. 2. The general flow of the abnormality diagnosis processing will now be described with reference to FIG. 2 and FIGS. 6A to 6D.

In step S11, an atmospheric air open mode processing for correction check is executed (from a time t0 to a time t1 in FIGS. 6A to 6D). In this processing step, the vent shut valve 26, the bypass valve 24, and the puff-loss valve 22 are opened, the purge control valve 30 is closed, and the jet purge control valve 29 is opened, and this valve operating 30 state is held for a predetermined time period T1.

In step S12, a correction check mode processing is executed (from the time t1 to a time t2 in FIGS. 6A to 6D). In this processing step, only the vent shut valve 26 is closed in the valve operating state in step S11 and the resultant valve operating state is held for a predetermined time period T2. An amount of change ΔP1 in tank pressure PTANK during the predetermined time period T2 is measured. In this valve operating state, the tank pressure PTANK slightly increases due to the evaporative fuel generated in the fuel tank 9.

In step S13, an atmospheric air open mode processing for pressure reduction is executed (from the time t2 to a time t3 in FIGS. 6A to 6D). In this processing step, only the vent shut valve 26 is opened in the valve operating state in step S12 and the resultant valve operating state, which is identical to that in step S11, is held for a predetermined time period T3. With this valve operating state, the pressure in the evaporative fuel processing system 31 becomes equal to atmospheric pressure.

In step S14, a pressure reduction mode processing is executed (from the time t3 to a time t4 in FIGS. 6A to 6D). In this processing step, the vent shut valve 26 is closed and both the purge control valve 30 and the jet purge control valve 29 are opened in the valve operating state in step S13, to execute a pressure reduction process by introducing a negative pressure (a pressure lower than atmospheric pressure) in the intake pipe 2 into the evaporative fuel processing system 31 until the pressure in the fuel tank 9 is reduced to a predetermined pressure, for example, a pressure lower than atmospheric pressure by about 2.0 kPa (15 mmHg).

In step S15, a leak check mode processing is executed (from the t4 to a time t5 in FIGS. 6A to 6D). In this processing step, both the purge control valve 30 and the jet purge control valve 29 are closed in the valve operating state in step S14 and the resultant valve operating state is held for a predetermined time period T4, and an amount of a change ΔP2 in the tank pressure PTANK during the predetermined time period T4 is measured. If there exists no leak in the evaporative fuel processing system 31, the pressure change ΔP2 is small as shown by a solid line in FIG. 6A. On the contrary, if there exists a leak, the pressure change ΔP2 becomes large as shown by a broken line in FIG. 6A. Accordingly, whether or not there exists a leak in the system 31 can be determined based on whether the pressure change ΔP2 is large or small. It is noted that the predetermined time period T4 is set to equal the predetermined time period T2 in this embodiment.

In step S16, a vapor check mode processing is executed (from the time t5 to a time t6 in FIGS. 6A to 6D). In this processing step, the vent shut valve 26 is opened in the valve operating state in step S15 and the resultant valve operating states is held for a predetermined time period T5. If the tank pressure PTANK, immediately after the vent shut valve 26 is opened, increases toward the atmospheric pressure from a value lower than the atmospheric pressure, then it is determined that an amount of vapor (evaporative fuel) generated in the fuel tank 9 is equal to or smaller than a predetermined amount. However, if the tank pressure PTANK, immediately after the vent shut valve 26 is opened, decreases toward atmospheric pressure from a value higher than atmospheric pressure, then it is determined that the amount of generated vapor is larger than the predetermined amount.

In step S17, it is determined, on the basis of the result of the processing in step S16, whether or not the amount of generated vapor is equal to or smaller than the predetermined amount. When the answer is negative (NO), that is, when the amount of generated vapor is larger than the predetermined amount, even if there exists a leak, the leak cannot be accurately diagnosed because the pressure change ΔP2 in the leak check mode becomes excessively small. Accordingly, the leak determination is withheld and the re-diagnosis is requested (step S18). Thereafter the abnormality diagnosis processing is ended.

When the answer to step S17 is affirmative (YES), the processing goes to step S19 in which it is determined whether or not a difference between the pressure change ΔP2 measured in step S15 and the pressure change ΔP1 measured in step S12 is larger than a predetermined pressure change amount ΔPLEAK. In other words, when the amount of generated vapor is equal to or smaller than the predetermined amount, it is determined whether or not the pressure change amount (=ΔP2−ΔP1) excluding the effect of the vapor pressure of the evaporative fuel is larger than ΔPLEAK.

If (ΔP2−ΔP1) is larger than ΔPLEAK, then it is determined that there exists a failure (leak) in the evaporative fuel processing system 31 (step S20). However, if (ΔP2−ΔP1) is smaller than or equal to ΔPLEAK, then it is determined that the evaporative fuel processing system 31 is normal (step S21). Then, the abnormality diagnosis processing is ended.

The pressure reduction mode processing according to this embodiment will be described in detail with reference to FIGS. 3 to 5 below.

According to this embodiment, since the tank pressure sensor 11 is not mounted in the fuel tank 9 but is mounted in the charging passage 20 at a position near the branch passages 20*a* to 20*c* provided in the engine room, a difference between the output value PTANK from the tank pressure sensor 11 and an actual pressure in the fuel tank 9 becomes large due to a pressure loss during the pressure reduction processing. Accordingly, there may occur an inconvenience that the pressure in the fuel tank 9 cannot be accurately detected and thereby the actual pressure in the fuel tank 9 cannot be accurately reduced to a target pressure. To cope with such an inconvenience, the pressure reduction mode processing according to this embodiment estimates the pressure in the fuel tank 9 on the basis of the output value PTANK from the tank pressure sensor 11 in accordance with a procedure shown in the flow charts in FIGS. 3 and 4, to thereby accurately reduce the actual pressure in the fuel tank 9 to the target pressure.

Figure 3:
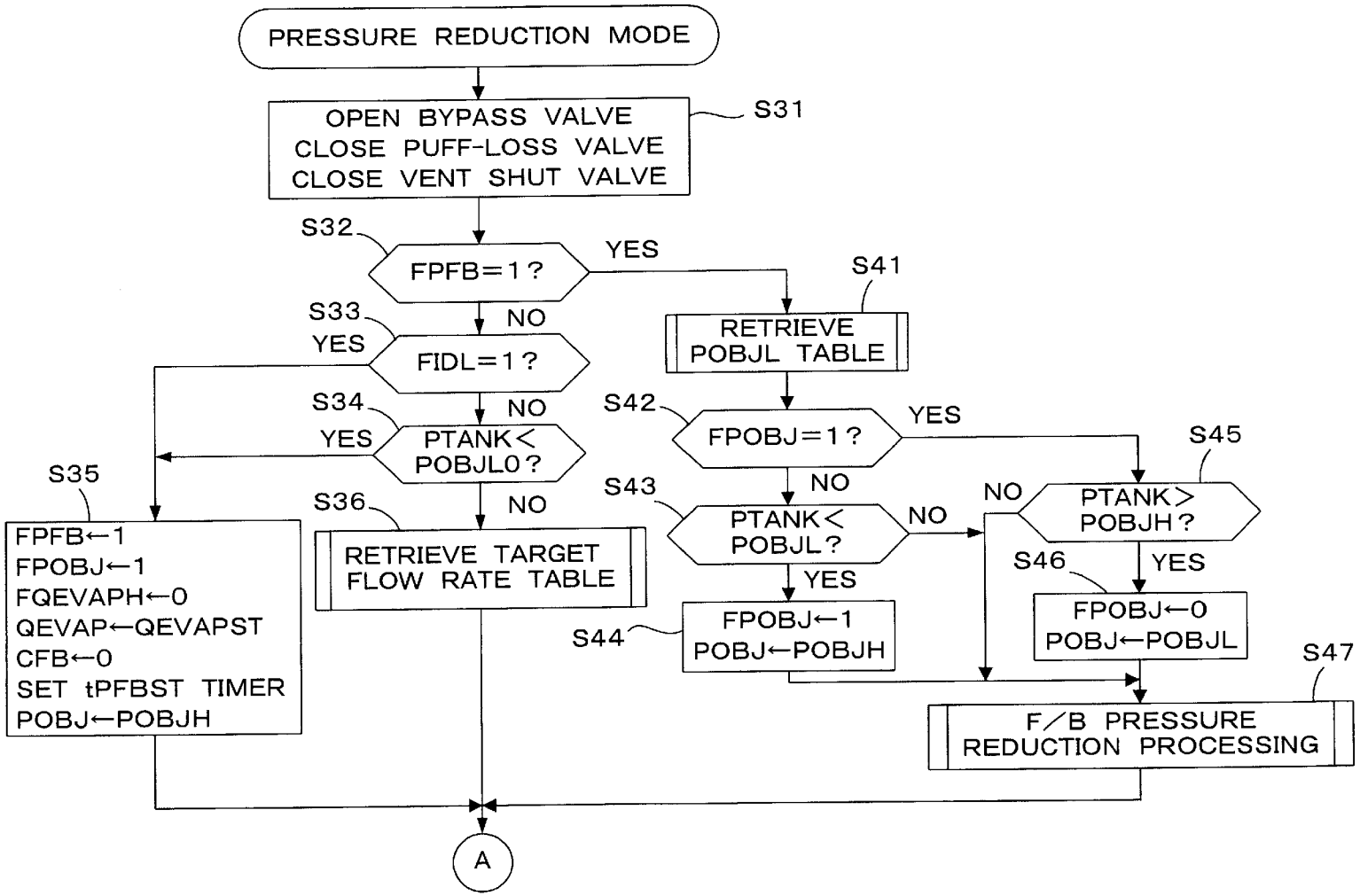
FIG. 3 is a flow chart illustrating the processing procedure of reducing a pressure in the evaporative fuel processing system.
Figure 4:
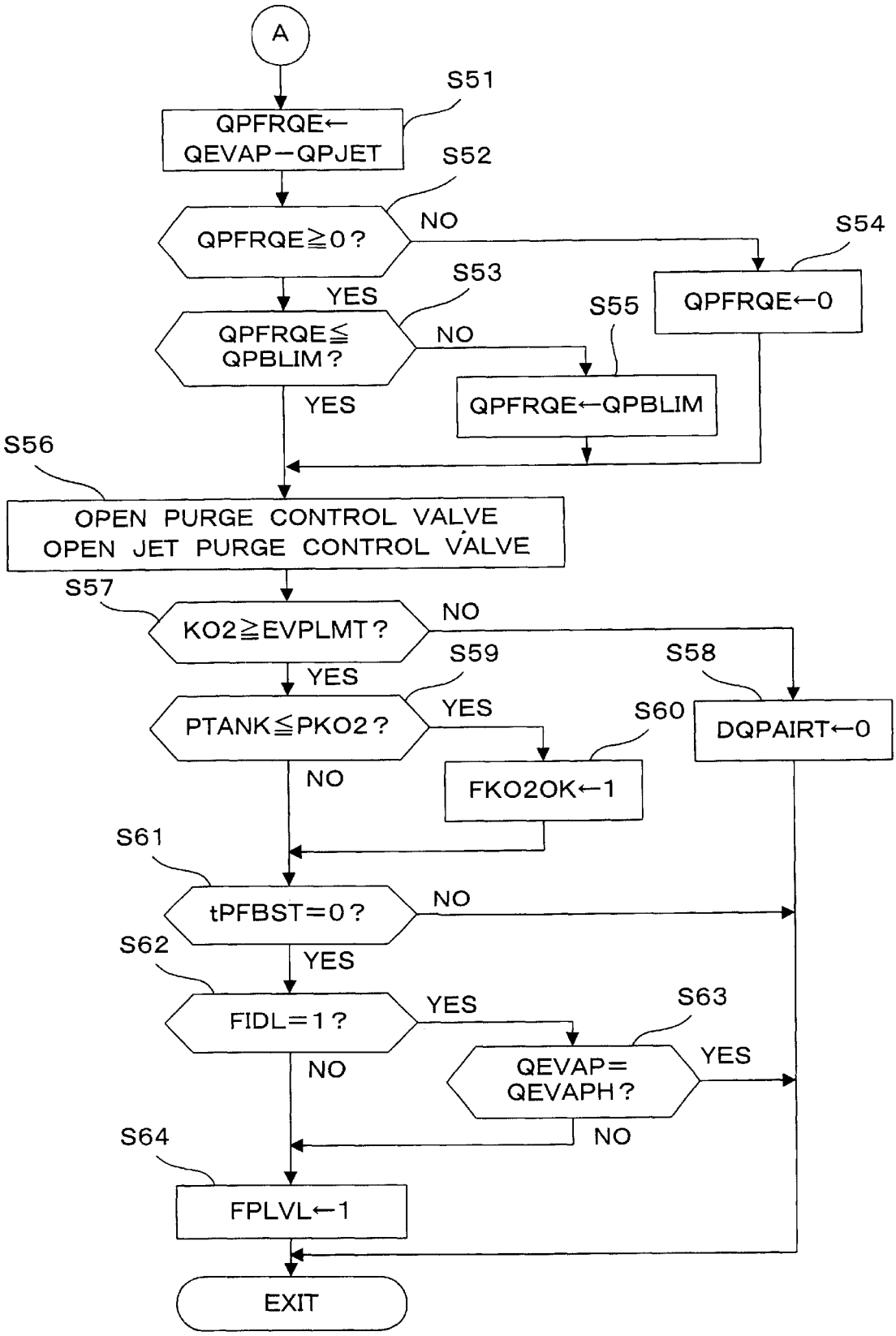
FIG. 4 is a flow chart further illustrating the processing procedure of reducing a pressure in the evaporative fuel processing system.

In step 31 of FIG. 3, the bypass valve 24 is in the opened state and both the puff-loss valve 22 and the vent shut valve 26 are closed. In step S32, it is determined whether or not a feed back pressure reduction flag FPFB is "1". The flag FPFB is set to "1" when the tank pressure PTANK becomes smaller than a pressure reduction target lower limit valve POBJL. Since the answer is negative (NO) at first, the processing goes to step S33 in which it is determined whether or not an idle flag FIDL is "1" (step S33). The flag FIDL is set to "1" when the engine 1 is in the idling condition. If FIDL is "0", that is, if the engine 1 is in operating conditions other than the idling condition, then the processing goes to step S34 for executing an open pressure reduction processing. However, if FIDL is "1", that is, if the engine 1 is in the idling condition, then the processing goes to step S35 for immediately executing a feedback pressure reduction processing.

In step S34, it is determined whether or not the Tank pressure PTANK is lower than an initial value POBJL0 of the pressure reduction target lower limit value POBJL. Since the answer to step S34 is negative (NO) at first, the processing goes to step S36, in which a target flow rate table preliminarily stored in the memory of the ECU 5 is retrieved according to the present tank pressure PTANK, to determine a target purge flow rate QEVAP. Then, the processing goes to step S51 shown in FIG. 4.

The target flow rate table is set so that the QEVAP value increases with an increase in the tank pressure PTANK. It is noted that the initial value POBJL0 of the above-described pressure reduction target lower limit value POBJL is a value set in a POBJL table and corresponds to the initial value "0" of a counter CFB. The POBJL table is used for a feedback (F/B) pressure reduction processing shown in FIG. 5 and is set according to a value of the counter CFB which indicates a execution number of the F/B pressure reduction processing.

In step S51, a purge flow rate QPFRQE, to be controlled by the purge control valve 30 at the present cycle, is calculated by subtracting a flow rate QPJET at the jet purge control valve 29 from the target purge flow rate QEVAP retrieved in step S36. In step S52, it is determined whether or not the purge flow rate QPFRQE calculated in step S51 is equal to or greater than "0". If the answer is affirmative (YES), then it is determined whether or not the purge flow rate QPFRQE is equal to or less than a predetermined upper limit value QPBLIM (step S53). If the answer to step S53 is affirmative (YES), which indicates that a relationship of $0 \leqq -QPFRQE \leqq =QPBLIM$ is holds, then the processing goes to step S56. The predetermined upper limit value QPBLIM is set to a value, for example, about 50 L/min (Liters/minute), which is larger than an upper limit value QEVAPH during the feedback pressure reduction processing. The upper limit value QEVAPH is set to for example about 15 L/min.

If the answer to step S52 is negative (NO), then the purge flow rate QPFRQE is set to the lower limit value "0" in step S54. If the answer to step S53 is negative (NO), then the purge flow rate QPFRQE is set to the predetermined upper limit value QPBLIM. Then, the processing goes to step S56.

A duty ratio of the purge control valve 30 is calculated on the basis of the purge flow rate QPFRQE set in the above-described processings, the tank pressure PTANK and the intake pipe absolute pressure PBA.

In step S56, the purge control valve 30 is opened at an opening degree corresponding to the duty ratio calculated as described above, while the jet purge control valve 29 is kept in the opened state. Then, the processing goes to step S57 in which it is determined whether or not the air-fuel ratio correction coefficient KO2 is equal to or greater than a predetermined threshold value EVPLMT. If the answer is negative (NO), then it is determined that a large amount of the evaporative fuel is generated and thereby the KO2 value may largely change to a lean limit value. Therefore, the processing goes to step S58 in which a purge accumulated flow rate DQPAIRT is reset to "0", which ends the abnormality diagnosis processing, and ends this routine.

The purge accumulated flow rate DQPAIRT is a parameter calculated by accumulating the intake pipe absolute pressure PBA, and the tank pressure PTANK from the start of the engine, and the actual purge flow rates calculated on the basis of the opening degree of the purge control valve 30. The condition that the purge accumulated flow rate DQPAIRT is equal to or greater than the predetermined value is included in an abnormality diagnosis execution condition to allow execution of the abnormality diagnosis. Accordingly, when the purge accumulated flow rate DQPAIRT is set to "0", the abnormality diagnosis execution condition is not satisfied, and the abnormality diagnosis processing is interrupted.

If the answer to step S57 is affirmative (YES), then it is determined that the amount of the generated evaporative fuel is small and the abnormality diagnosis can be executed under a stable air-fuel ratio. Thus, the processing goes to step S59. In step S59, it is determined whether or not the Tank pressure PTANK is equal to or less than a predetermined threshold value PKO2. If PTANK is higher than PKO2, then the processing immediately goes to step S61. On the other hand, if PTANK is lower than or equal to PKO2, then it is determined that the evaporative fuel is purged and the pressure of the fuel tank is reduced to a negative pressure. At this time, a flag FKO2OK indicating, the presence of a flow of the air-fuel mixture is set to "1" (step S60) and the processing then goes to step S61.

In step S61, it is determined whether or not the value of a down-count timer tPFBST for determining an end time of the feedback pressure reduction processing has become "0". Since the answer to step S61 is negative (NO) during the open pressure reduction processing, this processing is immediately ended.

As a result of continuation of the pressure reduction processing, when the tank pressure PTANK becomes lower than POBJL0 (i.e. the answer to step S34 shown in FIG. 3 becomes affirmative (YES)), the processing goes to step S35. In step S35, the following items (1) to (7) are sequentially executed.

(1) The feedback pressure reduction flag FPFB is set to "1".

(2) A pressure rise flag FPOBJ is set to "1". The flag FPOBJ is set to "1" until the tank pressure PTANK reaches a pressure reduction target upper limit value POBJH after the tank pressure PTANK becomes lower than the pressure reduction target lower limit value POBJL.

(3) An upper limit sticking flag FQEVAPH is set to "0". The flage FQEVAPH is set in the F/B pressure reduction processing (step S47 in FIG. 5) and which indicates, when set to "1", that the target purge flow rate QEVAP is stuck on the upper limit.

(4) The target purge flow rate QEVAP is set to an initial value QEVAPST.

(5) The value of the CFB counter for counting the execution number of the F/B pressure reduction processing (step S47) is set to "0".

(6) The timer tPFBST for determining the end time of the FIB pressure reduction processing is set to a predetermined time period T13 (e.g., 5 sec), and started.

(7) The pressure reduction target value POBJ is set to the pressure reduction target upper limit value POBJH.

Thereafter, steps S51 to S61 are executed, and the open pressure reduction processing is ended. At this time, the tank pressure PTANK is reduced to a value smaller than the lower limit value POBJL0.

From the next cycle, since the feedback pressure reduction flag FPFB has been set to "1", the answer to step S32 becomes affirmative (YES), and the processing goes to step S41. In step S41, a POBJL table preliminarily stored in the memory of the ECU 5 is retrieved according to the count value of the CFB counter indicating the execution number of the F/B pressure reduction processing (see FIG. 5), to determine the lower limit value POBJL of the pressure reduction target value POBJ. The POBJL value in the POBJL table is set so that the POBJL value becomes closer to the pressure reduction target upper limit value POBJH as the count value of the CFB counter becomes larger.

Then, it is determined whether or not the pressure rise flag FPOBJ is "1" (step S42). Since the flag FPOBJ is set to "1" in step S35, the answer is affirmative (YES) at first, and the processing goes to step S45. In step S45, it is determined whether or not the present tank pressure PTANK is larger than the pressure reduction target upper limit value POBJH. Since the tank pressure PTANK is lower than POBJH at first, the processing immediately goes to step S47, to execute the F/B pressure reduction processing shown in FIG. 5.

Figure 5:
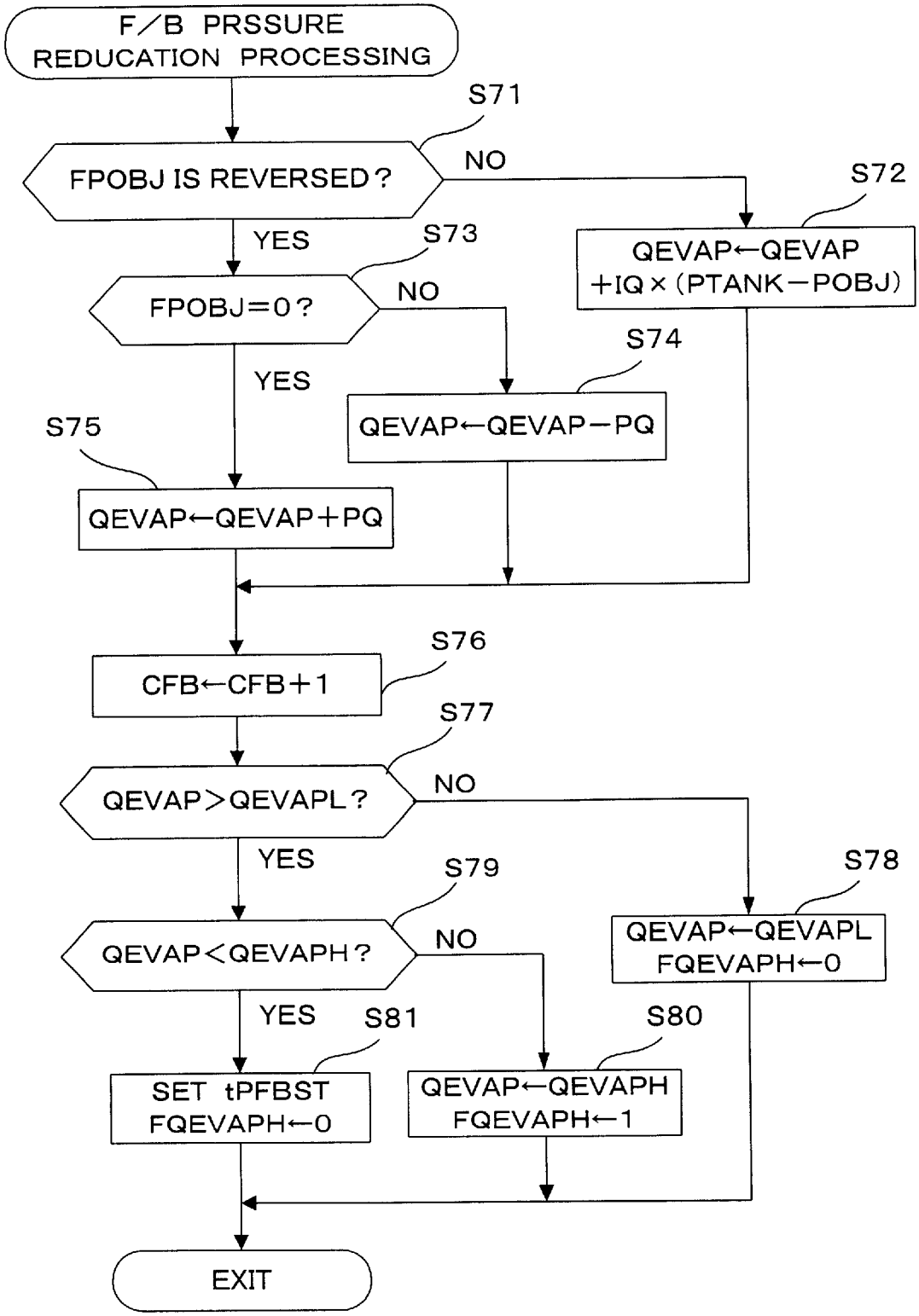
FIG. 5 is a flow chart of a feedback (F/B) pressure reduction processing executed in the processing steps shown in FIG. 3.
Figures 6A, 6B, 6C, 6D:
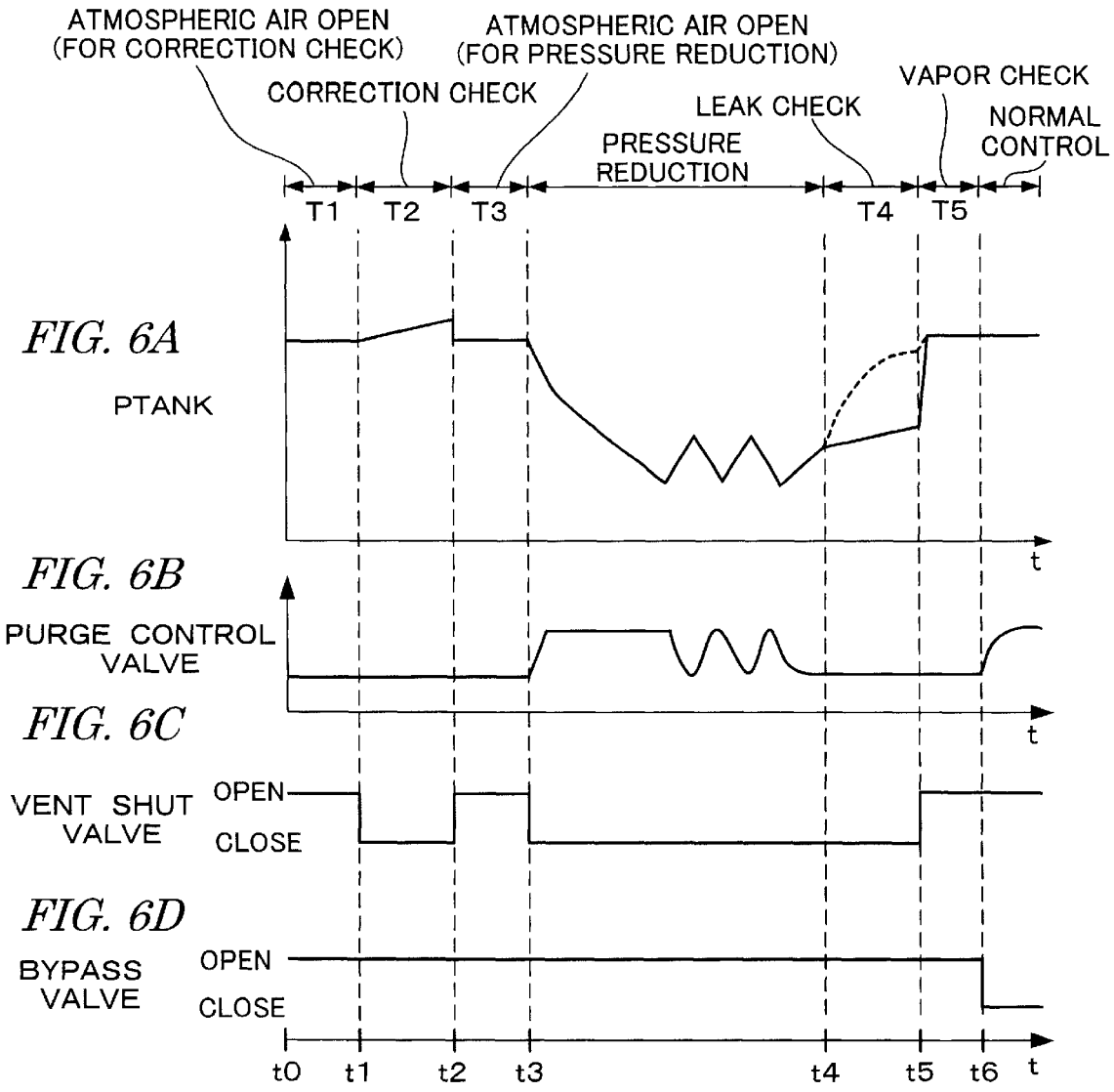
FIGS. 6A to 6D are time charts illustrating the whole of the abnormality diagnosis processing shown in FIG. 2.

In step S71 shown in FIG. 5, it is determined whether or not the pressure rise flag FPOBJ is reversed after the F/B pressure reduction processing is started. Since the answer is negative at first, the processing goes to step S72. In step S72, in order to reduce the target purge flow rate QEVAP, the target purge flow rate QEVAP is set to a value expressed by the following equation (2):

$$QEVAP=QEVAP+IQ\times(PTANK-POBJ) \quad (2)$$

where IQ is a control gain of an integral (I) term of the purge flow rate.

In the equation (2), the control gain IQ is set to a predetermined value. The pressure reduction target value POBJ is set to the upper limit value POBJH (step S35 in FIG. 3), and the tank pressure PTANK is lower than POBJ. Therefore, according to the equation (2), the target purge flow rate QEVAP is reduced.

The processing then goes to step S76 in which the CFB counter for counting the execution number of the F/B pressure reduction processing is incremented, and then the processing goes to step S77 in which it is determined whether or not the target purge flow rate QEVAP is larger than a lower limit value QEVAPL. If the answer is affirmative (YES), then the processing goes to step S79 in which it is determined whether or not the target purge flow rate QEVAP is smaller than the upper limit value QEVAPH. And if the answer to that is also affirmative (YES), which indicates that the relationship of QEVAPL<QEVAP<QEVAPH is satisfied, then the processing goes to step S81. In Step S81, the predetermined time period T13 is set in the tPFBST timer for measuring a time elapsed after the QEVAP value is stuck on the limit value and determining the end time of the F/B pressure reduction processing and the tPFBST timer is started. Simultaneously, the upper limit sticking flag FQEVAPH is set to "0". The flag FQEVAP is set to "1" when the target purge flow rate QEVAP sticks to the upper limit value QEVAPH. Then, the F/B pressure reduction processing ends.

On the other hand, if the answer to step S77 is negative (NO), then the target purge flow rate QEVAP is set to the lower limit value QEVAPL and the upper limit sticking flag FQEVAPH is set to "0" (step S78). Thereafter, the F/B pressure reduction processing ends. Further, if the answer to step S79 is negative (NO), then the target purge flow rate QEVAP is set to the upper limit value QEVAPH and the upper limit sticking flag FQEVAPH is set to "1" (step S80). Thereafter, the F/B pressure reduction processing ends.

As a result of reducing the target purge flow rate QEVAP, the tank pressure PTANK increases. When the tank pressure PTANK becomes higher than POBJH, the answer to step S45 (see FIG. 3) becomes affirmative (YES). At this time, the processing goes to step S46 in which the pressure rise flag FPOBJ is returned to "0" and the pressure reduction target value POBJ is set to the lower limit value POBJL calculated according to the count value of the CFB counter in step S41. The lower limit value POBJL at this time is set to a value which is closer to the upper limit value POBJH than the previous value.

The processing goes from step S46 to step S47, in which the F/B pressure reduction processing shown in FIG. 5 is executed. Since the answer to step S71 is affirmative (YES) at this time, the processing goes to step S73 in which it is determined whether or not the pressure rise flag FPOBJ is "0". Since the answer is affirmative (YES) at this time, the processing goes to step S75. In step S75, in order to increase the target purge flow rate QEVAP, the target purge flow rate QEVAP is set to a value expressed by the following equation (3):

$$QEVAP=QEVAP+PQ \tag{3}$$

where PQ is a control gain of a proportional (P) term of the purge flow rate.

Then, step S76 and the consecutive steps are executed, and the F/B pressure reduction processing ends.

At the next cycle, when the processing goes to step S42 shown in FIG. 3, the pressure rise flag FPOBJ is set to "0". Accordingly, the processing goes to step S43 in which it is determined whether or not the tank pressure PTANK is lower than the lower limit value POBJL. Since the answer is negative (NO) at first, the processing immediately shifts to the F/B pressure reduction processing (step S47). Steps S71 and S72 are repeated in the F/B pressure reducing processing, so that the target purge flow rate QEVAP gradually increases, and correspondingly the tank pressure PTANK gradually decreases.

When the tank pressure PTANK becomes smaller than the pressure reduction target lower limit value POBJL, the answer to step S43 (see FIG. 3) becomes affirmative (YES), and the processing goes to step S44 in which the pressure rise flag FOBJ is set to "1" and the pressure reduction target value POBJ is set to the upper limit value POBJH. Then, the processing shifts to the F/B pressure reduction processing (step S47). At this time, the processing goes from step S71 to step S74 by way of step S73. In step S74, in order to decrease the target purge flow rate QEVAP, the target purge flow rate QEVAP is set to a value expressed by the following expression (4):

$$QEVAP=QEVAP-PQ \tag{4}$$

Thereafter, the above-described processings are repeated. When the count value of the tPFBST timer becomes "0" in the next or later cycle, the answer to step S61 (see FIG. 4) becomes affirmative (YES). At this time, it is determined that the pressure rise flag FPOBJ is not reversed over the predetermined time period T13. In other words, the predetermined time T13 is elapsed after the target purge flow rate QEVAP sticks to the upper limit value QEVAPH or the lower limit value QEVAPL. Then, the processing goes to step S62 in which it is determined whether or not the idle flag FIDL is "1". If FIDL is "0", which indicates that the engine is in operating conditions other than the idling condition, a pressure reduction end flag FPLVL is set to "1" (step S64). When the flag FPLVL is set to "1", it indicates that the pressure reduction processing has ended, and the pressure reduction mode processing has also ended.

On the other hand, if FIDL is "1", which indicates that the engine is in the idling condition, it is determined whether or not the target purge flow rate QEVAP is equal to the upper limit value QEVAPH (step S63). If QEVAP is equal to QEVAPH, then the processing immediately ends, and the pressure reduction mode processing continues. If the target purge flow rate QEVAP does not equal to the upper limit value QEVAPH, which means that the target purge flow rate sticks to the lower limit value QEVAPL, then the processing goes to step S64 in which the pressure reduction end flag FPLVL is set to "1", and the pressure reduction mode processing ends.

It is to be noted that if the processing in step S62 is executed within the predetermined upper limit time period and the pressure reduction mode processing does not end, then the pressure reduction mode processing is forcibly ended by a processing not shown.

Figure 7A:
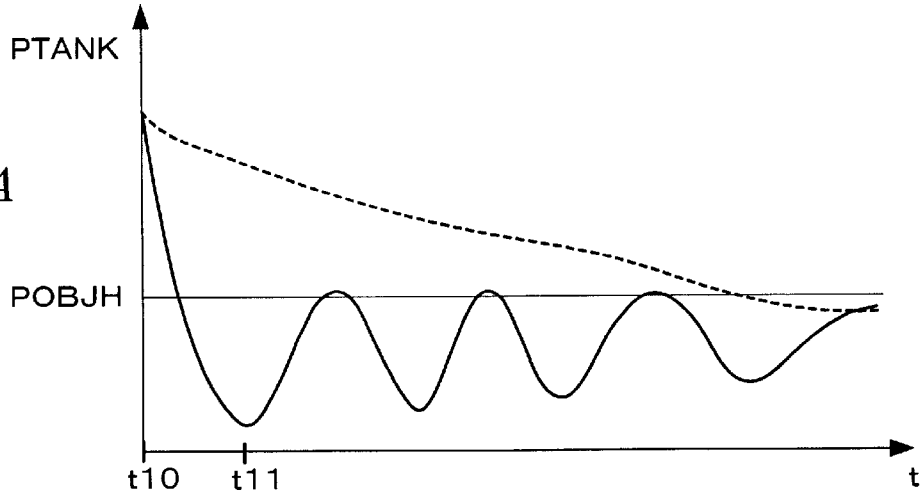
FIGS. 7A to 7C are time charts illustrating a pressure reduction mode processing in an operating condition other than an idling condition.
Figure 7B:
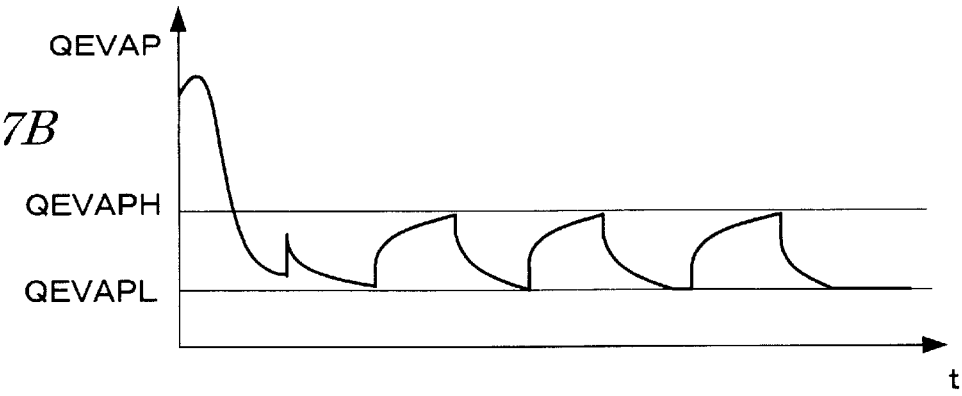
Figure 7C:
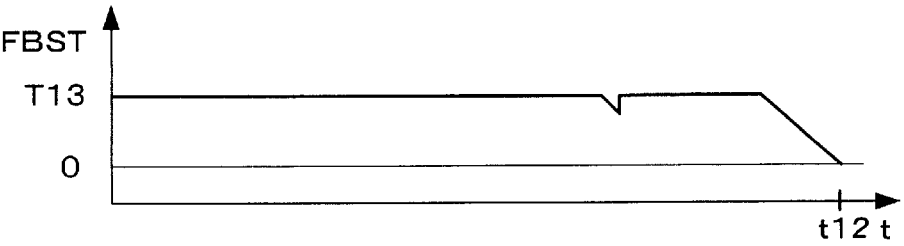

FIGS. 7A, 7B, and 7C are graphs respectively showing changes in values of the tank pressure PTANK, the target purge flow rate QEVAP, and the tPFBST timer in the pressure reduction mode of the abnormality diagnosis processing executed in engine operating conditions other than the idling condition. It is noted that a broken line shown in FIG. 7A indicates a change in actual pressure (estimated value) in the fuel tank 9 with time.

After the start of the pressure reduction mode processing at a time t10, the open pressure reduction processing is first executed. At this time, the target purge flow rate QEVAP is set according to the tank pressure PTANK in step S36 of FIG. 3. Since the tank pressure PTANK is close to the atmospheric pressure at first, the target purge flow rate QEVAP increases to the maximum flow rate which is allowable in purging the evaporative fuel, for example, about 50 L/min. Accordingly, the tank pressure PTANK decreases rapidly. When the tank pressure PTANK becomes lower than the lower limit value POBJL0 at a time t11, the open pressure reduction processing ends and the feedback pressure reduction processing starts. Finally, when the value of the tPFBST timer becomes "0" at a time t12, the pressure reduction mode processing ends.

Figure 8A:
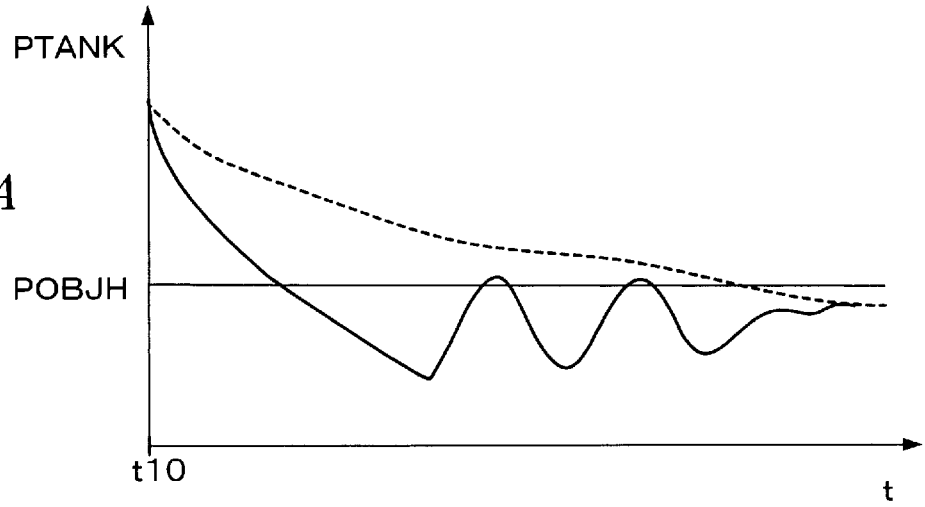
FIGS. 8A to 8C are time charts illustrating the pressure reduction mode processing in the idling condition.
Figure 8B:
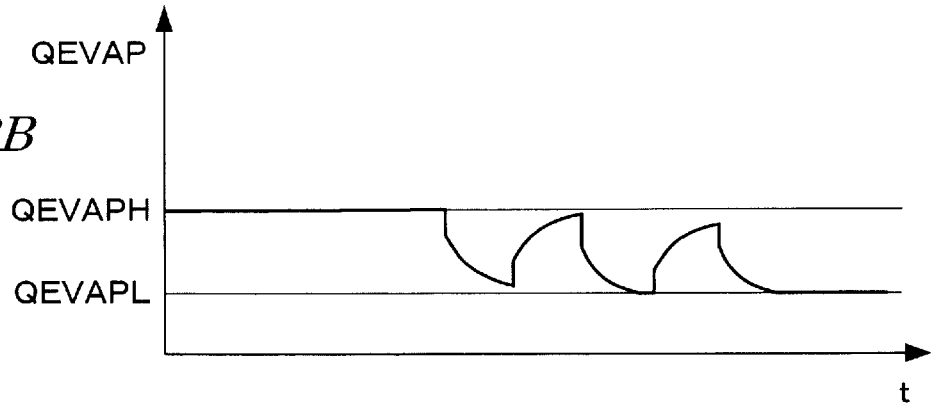
Figure 8C:
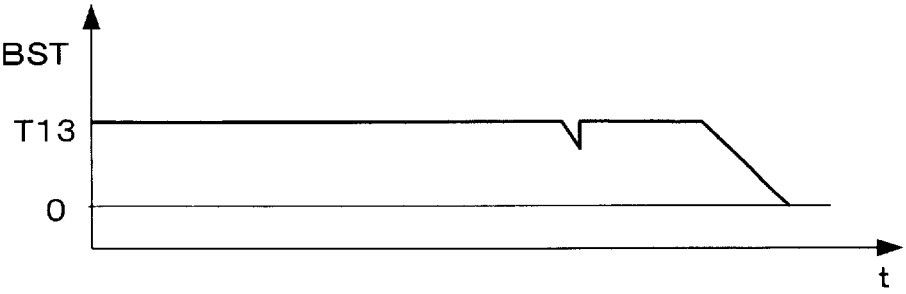

FIGS. 8A, 8B, and 8C are graphs respectively showing changes in values of the tank pressure PTANK, the target purge flow rate QEVAP, and the tPFBST timer in the pressure reduction mode of the abnormality diagnosis processing executed in the idling condition of the engine. It is noted that, like the broken line shown in FIG. 7A, a broken line shown in FIG. 8A indicates a change in actual pressure (estimated value) in the fuel tank 9 with time.

After the start of the pressure reduction mode processing at a time t10, the feedback pressure reduction mode processing is immediately started. At this time, since the tank pressure PTANk is high, the target purge flow rate QEVAP is sticking to the upper limit value QEVAPH. Since the upper limit value QEVAPH is set to, for example, about 15 L/min, the purge flow rate does not become large, unlike the case shown in FIGS. 7A to 7C. Therefore, the excessive supply of the evaporative fuel to the intake system of the engine is avoided.

According to the pressure reduction mode processing described above, the purge flow rate is increased or decreased according to the output value PTANK from the tank pressure sensor 11 in the F/B pressure reduction processing subsequent to the open pressure reduction processing. During the F/B pressure reduction processing, the lower limit value POBJL of the pressure reduction target value POBJ is changed in such a manner that the lower limit value POBJL becomes closer to the upper limit value POBJH, in order to reduce the amplitude of the tank pressure PTANK and finally make the tank pressure PTANK coincide with the pressure reduction target value POBJ. During this process, the purge flow rate gradually decreases as a whole and becomes constant at the lower limit value QEVAPL when the tank pressure PTANK coincide with the pressure reduction target value POBJ.

In this way, since the tank pressure PTANK is gradually reduced by increasing or decreasing the purge flow rate, the pressure loss during the pressure reduction process is eliminated. The difference between the output value PTANK of the tank pressure sensor 11 and the actual pressure in the fuel tank 9 becomes approximately zero when the tank pressure PTANK coincides with the pressure reduction target value POBJ. As a result, the tank pressure PTANK at the time when it coincides with the pressure reduction target value POBJ is estimated to be equal to the actual pressure in the fuel tank 9. Therefore, the pressure in the fuel tank 9 is accurately reduced to the pressure reduction target value.

According to this embodiment, when the engine 1 is in the idling condition, the feedback pressure reduction processing immediately starts without execution of the open pressure reduction processing, and the pressure reduction mode processing does not end, even if the target purge flow rate QEVAP sticks to the upper limit value QEVAPH. Accordingly, it is possible to prevent the purge flow rate from rapidly increasing due to execution of the open pressure reduction processing, to thereby avoid the excessive supply of the evaporative fuel to the engine. As a result, even in the idling condition of the engine, it is possible to execute the abnormality diagnosis for the evaporative fuel processing system without engine stall.

According to this embodiment, the abnormality diagnosis apparatus consists of the tank pressure sensor 11 and the ECU 5. Specifically, and the processings shown in FIGS. 2 to 5 correspond to a part of the abnormality diagnosis apparatus.

The present invention is not limited to the above-described embodiment but may be variously modified. For example, according to the above-described embodiment, in the idling condition of the engine 1, the feedback pressure reduction processing is immediately executed without execution of the open pressure reduction processing, to thereby perform the pressure reduction with the purge flow rate limited to a low value. However, the target purge flow rate QEVAP is actually fixed to the upper limit value QEVAPH of the purge flow rate. Accordingly, the open pressure reduction processing may be executed by setting the maximum flow rate to the upper limit value QEVAPH.

According to the above-described embodiment, the ECU5 for controlling the engine constitutes part of the abnormality diagnosis apparatus. However, the abnormality diagnosis apparatus may be configured as an external apparatus provided separately from the engine 1 and the control system thereof (ECU 5 or the like). In this case, the abnormality diagnosis apparatus as the external apparatus may be connected to the control system at the time of inspection or maintenance of the vehicle. When the engine 1 is operating in the idling condition, the abnormality diagnosis is executed by supplying execution command signals from the external abnormality diagnosis apparatus to the control system. In such a case, only the steps of pressure reduction mode processing shown in FIGS. 3 to 5, which are necessary for the idling condition of the engine, may be executed.

While the preferred embodiment of the present invention has been described using the predetermined terms, such description is for illustrative purposes only, and it is to be noted that changes and variations may be made without departing from the spirit or scope of the following claims.

What is claimed is:

1. An abnormality diagnosis apparatus for performing a leak check and for determining whether or not a leak exists in an evaporative fuel processing system which includes a fuel tank, a canister for storing evaporative fuel generated in said fuel tank, a charging passage for connecting said fuel tank to said canister, a purging passage for connecting said canister to an intake system of an internal combustion engine, and a purge control valve provided in said purging passage, said abnormality diagnosis apparatus comprising:

a pressure sensor for detecting a pressure in said evaporative fuel processing system;

pressure reduction processing means for executing a process of reducing the pressure in said evaporative fuel processing system with a limited flow rate of gases passing through said purge control valve when performing the leak check in an idling condition of said engine, wherein said limited flow rate being set to a value equal to or smaller than a predetermined flow rate which is smaller than the maximum flow rate applied to the leak check performed in operating conditions of said engine other than the idling condition; and leak determining means for performing the leak check on the basis of a change in the pressure in said evaporative fuel processing system after the pressure reduction process.

2. The abnormality diagnosis apparatus according to claim 1, wherein said abnormality diagnosis apparatus is an external apparatus provided separately from said engine and a control system wherein said engine is connected to said control system, wherein said control system is connected to said evaporative fuel processing system and controls said evaporative fuel processing system, and wherein said abnormality diagnosis apparatus performs the leak check by supplying an execution command signal to said control system.

3. The abnormality diagnosis apparatus according to claim 1, wherein said pressure sensor is mounted in said charging passage; and wherein said pressure reduction processing means executes the pressure reduction process by comparing a pressure detected by said pressure sensor with each of a first predetermined pressure and a second predetermined pressure lower than the first predetermined pressure, and gradually increasing the valve opening amount of said purge control valve when the detected pressure reaches the first predetermined pressure while gradually decreasing the valve opening amount of said purge control valve when the detected pressure reaches the second predetermined pressure.

4. The abnormality diagnosis apparatus according to claim 3, wherein the second predetermined pressure is set so that the second predetermined pressure gradually becomes closer to the first predetermined pressure with elapsed time.

5. The abnormality diagnosis apparatus according to claim 1, wherein said leak determining means corrects a raised amount of a pressure in said evaporative fuel processing system within a predetermined time period after the pressure reduction process by said pressure reduction processing means, according to a pressure change depending on the amount of evaporative fuel generated in said fuel tank; and wherein said leak determining means determines that there exists a leak in said evaporative fuel processing system, when a pressure raised amount after correction is larger than a predetermined pressure change amount.

6. The abnormality diagnosis apparatus according to claim 1, further comprising:

first evaporative fuel amount determining means for determining an amount of the evaporative fuel generated in said fuel tank during the pressure reduction processing, wherein the pressure reduction process is interrupted when it is determined by said first evaporative fuel amount determining means that the evaporative fuel amount is larger than a first predetermined amount.

7. The abnormality diagnosis apparatus according to claim 6, further comprising:

an oxygen concentration sensor for detecting an oxygen concentration in exhaust gases from said engine, wherein said first evaporative fuel amount determining means determines the evaporative fuel amount on the basis of an air-fuel ratio correction coefficient set according to an output of said oxygen concentration sensor.

8. The abnormality diagnosis apparatus according to claim 5, further comprising:

second evaporative fuel amount determining means for determining an amount of the evaporative fuel generated in said fuel tank after measurement of the pressure raised amount, wherein the determination of whether or not a leak exists in said evaporative fuel processing system is withheld when it is determined by said second evaporative fuel amount determining means that the evaporative fuel amount is larger than a second predetermined amount.

* * * * *